US011692402B2

(12) United States Patent
Clark et al.

(10) Patent No.: US 11,692,402 B2
(45) Date of Patent: Jul. 4, 2023

(54) DEPTH OF CUT CONTROL ACTIVATION SYSTEM

(71) Applicant: Halliburton Energy Services, Inc., Houston, TX (US)

(72) Inventors: Kevin Clark, Conroe, TX (US); Kelley Plunkett, Conroe, TX (US); Curtis Lanning, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/505,814

(22) Filed: Oct. 20, 2021

(65) Prior Publication Data

US 2023/0117681 A1 Apr. 20, 2023

(51) Int. Cl.

| | |
|---|---|
| ***E21B 10/62*** | (2006.01) |
| ***E21B 17/10*** | (2006.01) |
| ***E21B 10/32*** | (2006.01) |

(52) U.S. Cl.

CPC ..... *E21B 10/62* (2013.01); *E21B 10/322* (2013.01); *E21B 10/325* (2013.01); *E21B 17/1092* (2013.01)

(58) Field of Classification Search

CPC ..... E21B 10/62; E21B 10/627; E21B 10/633
See application file for complete search history.

(56) References Cited

U.S. PATENT DOCUMENTS

| | | | | |
|---|---|---|---|---|
| 5,099,934 | A | 3/1992 | Barr | |
| 6,142,250 | A * | 11/2000 | Griffin et al. | E21B 10/325 175/426 |
| 7,836,975 | B2 | 11/2010 | Chen et al. | |
| 7,849,939 | B2 | 12/2010 | Downton et al. | |
| 7,971,662 | B2 | 7/2011 | Beuershausen | |
| 8,061,455 | B2 | 11/2011 | Beuershausen | |
| 8,087,479 | B2 | 1/2012 | Kulkarni et al. | |
| 8,141,657 | B2 | 3/2012 | Hutton | |
| 8,205,686 | B2 | 6/2012 | Beuershausen | |
| 8,240,399 | B2 | 8/2012 | Kulkarni et al. | |
| 9,080,399 | B2 | 7/2015 | Oesterberg | |
| 9,267,329 | B2 | 2/2016 | Bilen | |
| 10,000,977 | B2 | 6/2018 | Jain et al. | |
| 10,273,759 | B2 | 4/2019 | Ricks et al. | |

(Continued)

FOREIGN PATENT DOCUMENTS

| | | | |
|---|---|---|---|
| WO | 2010099075 | A1 | 9/2010 |
| WO | 2013188206 | A1 | 12/2013 |

(Continued)

*Primary Examiner* — Blake Michener
(74) *Attorney, Agent, or Firm* — Michael Jenney; C. Tumey Law Group PLLC

(57) ABSTRACT

The disclosure provides a drill bit including a bit body and a blade extending from the bit body. The blade includes a first element protruding from a surface of the blade and a second element protruding from the surface of the blade. The first element and the second element are each configured to extend or retract relative to the surface of the blade and are coupled to each other such that when the second element retracts relative to the surface of the blade, the first element extends relative to the surface of the blade. The first element is disposed within a first pocket formed in the surface of the blade, and the second element is disposed within a second pocket formed in the surface of the blade. A communication channel is formed between the first pocket and the second pocket.

20 Claims, 6 Drawing Sheets

(56) References Cited

U.S. PATENT DOCUMENTS

| | | | | |
|---|---|---|---|---|
| 10,358,873 | B2 | 7/2019 | Do et al. | |
| 2009/0044979 | A1* | 2/2009 | Johnson et al. | E21B 7/06 175/24 |
| 2009/0065262 | A1 | 3/2009 | Downton et al. | |
| 2010/0071956 | A1 | 3/2010 | Beuershausen | |
| 2011/0031025 | A1 | 2/2011 | Kulkarni et al. | |
| 2011/0147089 | A1 | 6/2011 | Kulkarni et al. | |
| 2012/0255788 | A1 | 10/2012 | Schwefe et al. | |
| 2014/0174827 | A1 | 6/2014 | Schen et al. | |
| 2014/0262511 | A1 | 9/2014 | Bilen | |
| 2015/0152723 | A1 | 6/2015 | Hay | |
| 2015/0191979 | A1 | 7/2015 | Jain et al. | |
| 2016/0236578 | A1* | 8/2016 | Liao et al. | B60L 50/90 |
| 2017/0175455 | A1* | 6/2017 | Jain et al. | E21B 10/62 |
| 2017/0275951 | A1* | 9/2017 | Thomas | E21B 10/62 |
| 2020/0024906 | A1 | 1/2020 | Etebu et al. | |

FOREIGN PATENT DOCUMENTS

| | | | |
|---|---|---|---|
| WO | 2014165120 | A1 | 10/2014 |
| WO | 2016043755 | A1 | 3/2016 |
| WO | 2020018780 | A1 | 1/2020 |

* cited by examiner

DEPTH OF CUT CONTROL ACTIVATION SYSTEM

TECHNICAL FIELD OF THE INVENTION

The present disclosure relates generally to downhole drilling tools and, more particularly, to drill bits including depth of cut control.

BACKGROUND

Wellbores for the oil and gas industry are commonly drilled by a process of rotary drilling. Further, directional drilling, which involves drilling down to a predetermined depth and then drilling laterally to maximize the wellbores exposure to a reservoir, is common in the industry and requires vertical runs of drilling, curved runs of drilling, and lateral runs of drilling. In conventional wellbore drilling, a drill bit is mounted on the end of a drill string, which may be several miles long. At the surface of the wellbore, a rotary drive or top drive turns the drill string, including the drill bit arranged at the bottom of the hole to increasingly penetrate the subterranean formation, while drilling fluid is pumped through the drill string to remove cuttings. In other drilling configurations, the drill bit may be rotated using a downhole mud motor arranged axially adjacent the drill bit and powered using the circulating drilling fluid.

Various types of rotary drill bits, reamers, stabilizers, and other downhole tools may be used to drill into the earth to form a wellbore. Examples of such rotary drill bits for drilling oil and gas wells include, but are not limited to, fixed cutter drill bits and coring drill bits. Rotary drill bits may include multiple blades that each include multiple cutting elements. Cutting action associated with such drill bits generally requires rotation of associated cutting elements into adjacent portions of a downhole formation to penetrate or crush adjacent formation materials and remove the formation materials using a scraping action. Drilling fluid may also be provided to perform several functions including washing away formation materials and other downhole debris from the bottom of a wellbore, cleaning associated cutting structures and carrying formation cuttings radially outward and then upward to an associated well surface.

Typical formations may generally have a relatively low compressive strength in the upper portions (e.g., lesser drilling depths) of the formation and a relatively high compressive strength in the lower portions (e.g., greater drilling depths) of the formation. Thus, it typically becomes increasingly more difficult to drill at increasingly greater depths. As well, the ideal bit for drilling at any particular depth is typically a function of the compressive strength of the formation at that depth. Accordingly, the ideal bit and the ideal depth of cut of the drill bit typically changes as a function of drilling depth. For example, the optimal depth of cut is typically lower for curved runs of drilling where a more steerable, less aggressive bit is desired, while a more aggressive bit is desired for lateral runs of drilling. Thus, a drill bit that can adapt its depth of cut based on wellbore conditions in curved runs and lateral runs is desired.

Therefore, a drilling tool may include one or more depth of cut control ("DOCC") elements configured to control the aggressiveness of the drill bit, and thus the amount that a drilling tool cuts into a geological formation. However, conventional DOCC elements are disposed on external surfaces of drill bits and remain stationary during the entire drilling run. Thus, conventional drill bits with DOCC elements may not control the depth of cut of the cutting tools to the desired depth of cut for the entirety of the drilling run and may unevenly control the depth of cut with respect to each of the cutting elements on the drill bit. This uneven depth of cut control may allow for portions of the DOCCs to wear unevenly. Also, uneven depth of cut control may cause the drilling tool to vibrate, which may damage parts of the drill string or slow the drilling process.

Figure 1:
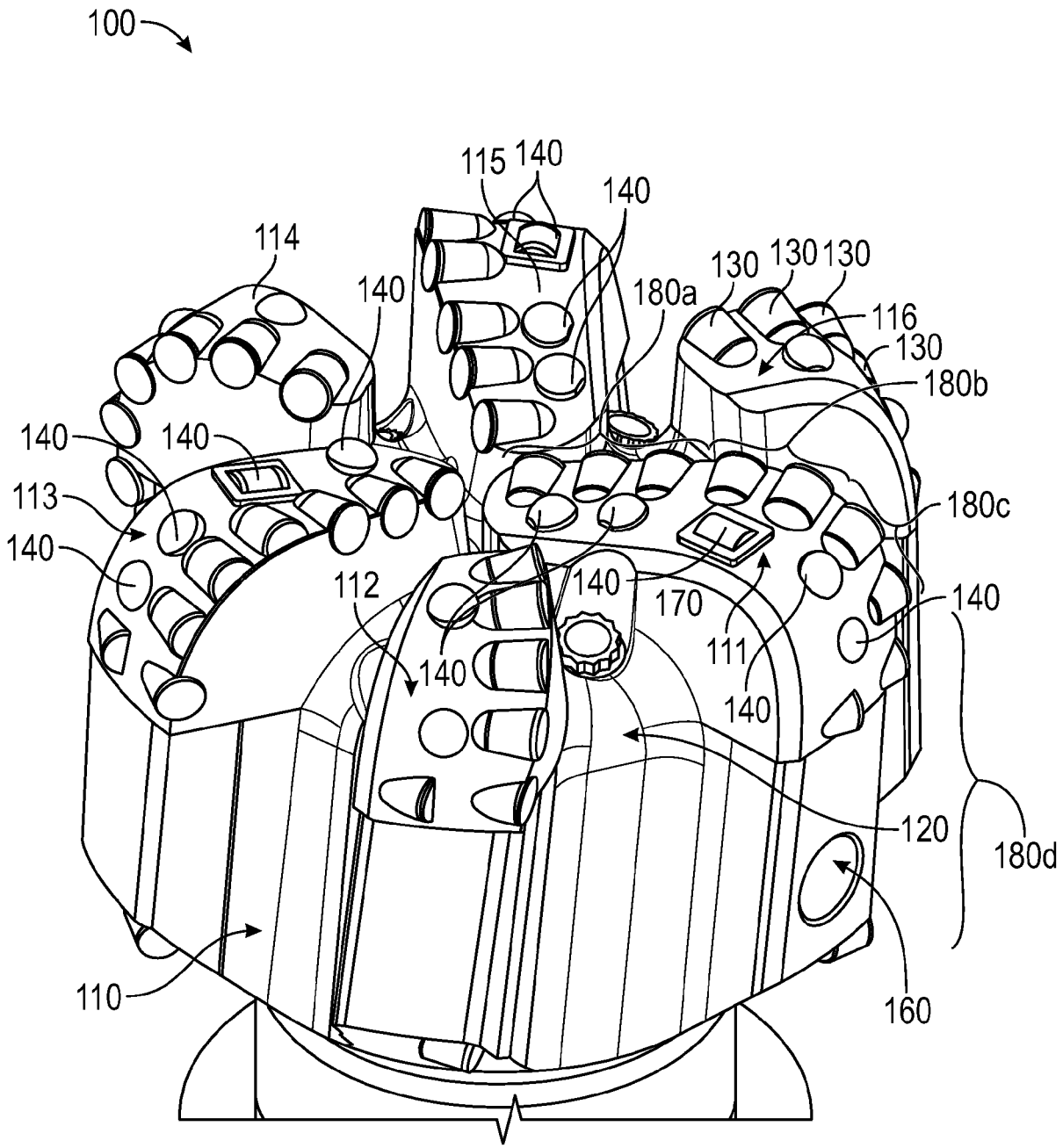
FIG. 1 is a diagram of an illustrative drill bit according to one or more aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

A drill bit able to adapt its depth of cut based on the wellbore conditions and weight on bit ("WOB") while performing directional drilling into a formation is desired. The drill bit may include a plurality of blades, and one or more of the plurality of blades may have a plurality of cutting elements, a DOCC element, and a gauge element. The DOCC elements may be disposed on an external surface of the blades and the gauge elements may be disposed on the gauge section of the drill bit. Further, in one or more embodiments, the DOCC element and the gauge element may be coupled such that when one of the DOCC element or the gauge element are retracted into the drill bit due to external forces from the wellbore, the other of the DOCC element or the gauge element are extended further from the surface of the drill bit. Thus, in one or more embodiments, the DOCC element may be extended or retracted to an optimal height above the surface of the drill bit based on the width of the wellbore, which changes as the drill bit drills vertically, laterally, and therebetween.

Illustrative embodiments of the present invention are described in detail herein. In the interest of clarity, not all features of an actual implementation may be described in this specification. It will of course be appreciated that in the development of any such actual embodiment, numerous implementation specific decisions may be made to achieve the specific implementation goals, which may vary from one implementation to another. Moreover, it will be appreciated that such a development effort might be complex and time consuming but would nevertheless be a routine undertaking for those of ordinary skill in the art having the benefit of the present disclosure.

The terms "couple" or "couples," as used herein are intended to mean either an indirect or direct connection. Thus, by way of example, if a first device couples to a second device, that connection may be through a direct physical or fluid connection or through an indirect connection by way of tubing, pistons, and/or valves. Further, the term "fluid" as used herein is intended to mean any liquid or gas or combination thereof, or generally any material that cannot sustain a tangential or shearing force when at rest and that undergoes a continuous change in shape when subjected to such stresses.

Furthermore, the terms "drill bit" and "drill bits" may be used in this application to include, but is not limited to, various types of fixed cutter drill bits and coring bits. Drill bits and associated components formed in accordance with teachings of the present disclosure may have many different designs and configurations. Drill bits 100, 200, 300, 400, and 500 as shown in FIGS. 1-5 represent only some examples of drill bits which may be formed in accordance with teachings of the present disclosure. Additionally, the terms "cutting element" and "cutting elements" may be used in this application to include various types of compacts, cutters, buttons, and/or inserts satisfactory for use with a wide variety of drill bits.

Further, the term "wellbore conditions" may sometimes be used to refer to parameters of the wellbore adjacent to the drill bit such as the width of the wellbore or the compressive strength of the wellbore. Additionally, the term "weight on bit" and its associated abbreviation, "WOB," may be used in this application to refer to the amount of downward force exerted on the drill bit.

Furthermore, the terms "downhole" and "uphole" may be used in this application to describe the location of various components relative to the bottom or end of a wellbore. For example, a first component described as "uphole" from a second component may be further away from the end of the wellbore than the second component. Similarly, a first component described as being "downhole" from a second component may be located closer to the end of the wellbore than the second component. Additionally, the term "bottom" may be used in this application to describe a portion of a of a groove or counterbore that is the lowest point below a surface in which the groove or counterbore is formed.

Referring now to FIG. 1, a drill bit 100 according to one or more aspects of the present disclosure is illustrated. In one or more embodiments, the drill bit 100 may include a bit body 110 from which extend a plurality of blades 111-116 with respective junk slots or fluid flow paths 120 disposed therebetween. In one or more embodiments, an exterior portion of the plurality of blades 111-116 may include a plurality of cutting elements 130 and depth of cut control elements ("DOCC elements") 140. The plurality of cutting elements 130 and DOCC elements 140 may be configured to protrude from a surface of the blades 111-116 of the drill bit 100. The DOCC elements may be configured to control the depth of cut of the plurality of cutting elements 130. In one or more embodiments, the DOCC elements 140 may include a roller element, an impact arrestor, a backup cutter, and/or a Modified Diamond Reinforcement ("MDR"). Further, in one or more embodiments, the DOCC elements 140 may be configured to extend or retract between a first position in which the DOCC elements 140 protrude from the surface of the blades 111-116 by a first distance and a second position in which the DOCC elements 140 protrude from the surface of the blades 111-116 by a second distance, which is less than the first distance. The DOCC elements 140 are configured to control the depth of cut of the drill bit as necessitated by the wellbore conditions and the WOB while drilling. Further, in one or more embodiments, one or more springs (not shown) may be disposed behind the DOCC elements 140 so as to bias the DOCC elements 140 outward from the surface of the blades 111-116.

In one or more embodiments, the exterior portion of the plurality of blades 111-116 may include a cone zone 180*a*, a nose zone 180*b*, a shoulder zone 180*c*, and a gauge zone 180*d*, and the plurality of cutting elements 130 may be disposed in one or more zones along the exterior portion of the plurality of blades 111-116. Additionally, in one or more embodiments, the DOCC elements 140 may be disposed in the nose zone 180*b* of the plurality of blades 111-116. However, in other embodiments, the DOCC elements 140 may be disposed in one or more of the cone zone 180*a*, the nose zone 180*b*, and/or the shoulder zone 180*c* of the plurality of blades 111-116.

Further, in one or more embodiments, cutting elements 130 may include substrates with a layer of hard cutting material disposed on one end of each respective substrate. The hard layer of cutting elements 130 may provide a cutting surface that may engage adjacent portions of a downhole formation to form the wellbore. Each substrate of cutting elements 130 may have various configurations and may be formed from tungsten carbide or other materials associated with forming cutting elements for drill bits.

Furthermore, in one or more embodiments, each of the plurality of blades 111-116 may include a gauge element 160 disposed in the gauge zone 180*d*. The plurality of gauge elements 160 may be configured to protrude from a surface of the blades 111-116 of the drill bit 100. Further, in one or more embodiments, the gauge elements 160 may be configured to extend or retract between a first position in which the gauge elements 160 protrude from the surface of the blades 111-116 by a first distance and a second position in which the gauge elements 160 protrude from the surface of the blades 111-116 by a second distance, which is less than the first distance. The gauge elements 160 may engage adjacent portions of the wellbore and may be configured to enhance the stability of the drill bit 100 during both linear (i.e., vertical or lateral drilling) and non-linear (i.e., curved drilling between vertical and lateral) drilling. In one or more embodiments, the gauge elements 160 may have some, little, or no cutting capability.

Additionally, in one or more embodiments, the gauge elements 160 may be configured to extend from and retract into the bit body 110 based on engagement with adjacent portions of the wellbore. Further, in one or more embodiments, the gauge elements 160 may be biased radially outward from a central axis of the drill bit 100. One or more springs (not shown) may be disposed behind the gauge elements 160, in one or more embodiments, so as to bias the gauge elements 160 outward from the central axis of the drill bit 100. Thus, in one or more embodiments, springs may be disposed behind the DOCC elements 140, the gauge elements 160, or both.

Furthermore, the gauge element 160 of each of the plurality of blades 111-116 may be coupled to a corresponding DOCC element 140 of each of the plurality of blades 111-116 such that when the gauge elements 160 are retracted into the bit body 110 of the drill bit 100, the DOCC elements 140 are extended further from the surface of the blades 111-116, and such that when the gauge elements 160 are extended from the bit body 110, the DOCC elements 140 are retracted into the bit body 110. By way of example only, when the drill bit changes from drilling a non-linear portion of a wellbore to drilling a linear portion of the wellbore, the width of the wellbore may become larger, allowing the gauge elements 160 to extend further out of the gauge zone 180*d* of the blades 111-116 to engage the adjacent portion of the wellbore, and the extension of the gauge elements 160 causes the DOCC elements 140 to retract into the bit body 110 of the drill bit 100. The systems and methods of coupling the DOCC elements 140 and the gauge elements 160 will be described further below with regard to FIGS. 2-5.

Additionally, in one or more embodiments, the drill bit 100 may include nozzles 170 disposed along an exterior of the bit body 110. In one or more embodiments, drilling fluids and other fluids may be flowed through the nozzles 170 to exterior portions of the drill bit 100. Drilling fluids supplied to the drill bit 100 may perform several functions including, but not limited to, removing formation materials and other downhole debris from the bottom or end of a wellbore, cleaning associated cutting elements and cutting structures, and carrying formation cuttings and other downhole debris upward to an associated well surface. The drilling fluid and any cuttings or other downhole debris carried away from the drill bit may flow uphole through the junk slots or fluid flow paths 120 disposed between the blades 111-116.

Figure 2:
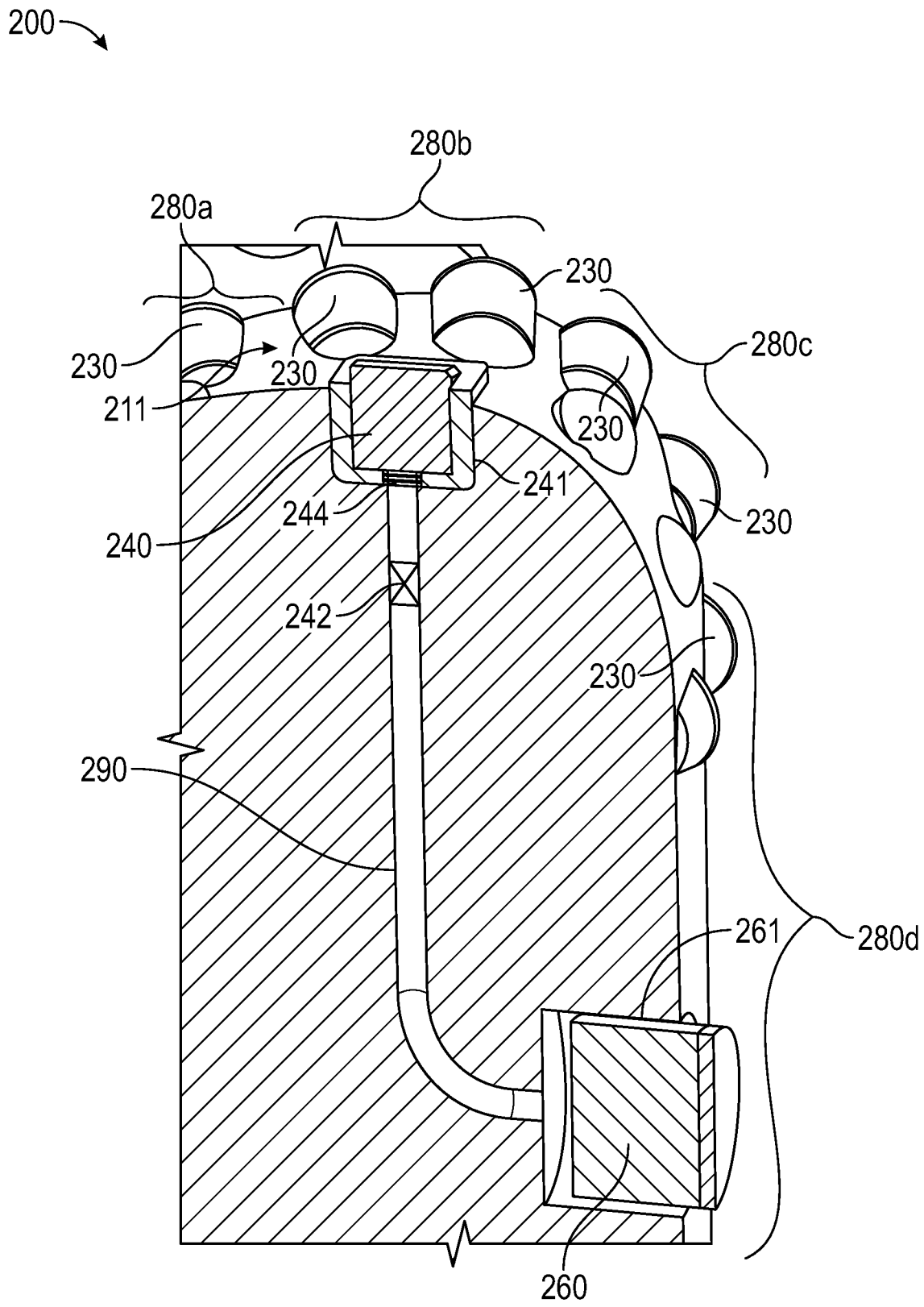
FIG. 2 is a cross section of an illustrative blade of a drill bit according to one or more aspects of the present disclosure.

Referring now to FIG. 2, a cross section of a blade 211 of a drill bit 200 is illustrated according to one or more aspects of the present disclosure. In one or more embodiments, the blade 211 may include a plurality of cutting elements 230, a DOCC element 240, and a gauge element 260. The plurality of cutting elements 230 and the DOCC element 240 may be configured to protrude from an external surface of the blade 211. Further, the DOCC element 240 may be disposed in and coupled to a first pocket 241 formed in the external surface of the blade 211. The DOCC element 240 may be configured to control the depth of cut of the plurality of cutting elements 230 as necessitated by the wellbore conditions and the WOB while drilling. In one or more embodiments, the DOCC element 240 may include a roller element, an impact arrestor, a backup cutter, and/or an MDR. Further, in one or more embodiments, the DOCC element 240 may be configured to extend or retract between a first position in which the DOCC element 240 protrudes from the surface of the blade 211 by a first distance and a second position in which the DOCC element 240 protrudes from the surface of the blade 211 by a second distance, which is less than the first distance. Further, in one or more embodiments, one or more springs 244 may be disposed behind the DOCC element 240 within the first pocket 241 so as to bias the DOCC element 240 outward from the surface of the blade 211. While a single DOCC element 240 is depicted, in one or more embodiments, the blade 211 may include a plurality of DOCC elements. Additionally, while the DOCC element 240 is depicted as being disposed in a nose zone 280*b* of the blade 211, in one or more embodiments, the DOCC element 240 may be disposed in the cone zone 280*a* or the shoulder zone 280*c* of the blade 211.

Further, the gauge element 260 may be configured to protrude from the external surface of the blade 211. In one or more embodiments, the gauge element 260 may be disposed in and coupled to a second pocket 261 formed in a gauge zone 280*d* of the blade 211. Further, in one or more embodiments, the gauge element 260 may be configured to extend or retract between a first position in which the gauge element 260 protrudes from the surface of the blade 211 by a first distance and a second position in which the gauge element 260 protrudes from the surface of the blade 211 by a second distance, which is less than the first distance. The gauge element 260 may engage adjacent portions of the wellbore and may be configured to enhance the stability of the drill bit 200 during both linear (i.e., vertical or lateral drilling) and non-linear (i.e., curved drilling between vertical and lateral) drilling. In one or more embodiments, the gauge element 260 may have some, little, or no cutting capability. Additionally, in one or more embodiments, the gauge element 260 may be configured to extend from and retract into the gauge zone 280*d* of blade 211 based on engagement with adjacent portions of the wellbore. Further, in one or more embodiments, the gauge element 260 may be biased radially outward from a central axis of the drill bit 200. One or more springs (not shown) may be disposed between the gauge element 260 and a bottom of the second pocket 261 in one or more embodiments so as to bias the gauge element 260 outward from the central axis of the drill bit 200. Thus, in one or more embodiments, springs may be disposed behind the DOCC element 240, the gauge element 260, or both. Furthermore, in one or more embodiments, the gauge element 260 of the blade 211 may be coupled to the DOCC element 240 such that when the gauge element 260 is retracted into the drill bit 200, the DOCC element 240 is extended from the surface of the blade 211, and such that when the gauge element 260 is extended from the drill bit 200, the DOCC element 240 is retracted into the drill bit 200.

Figure 6:
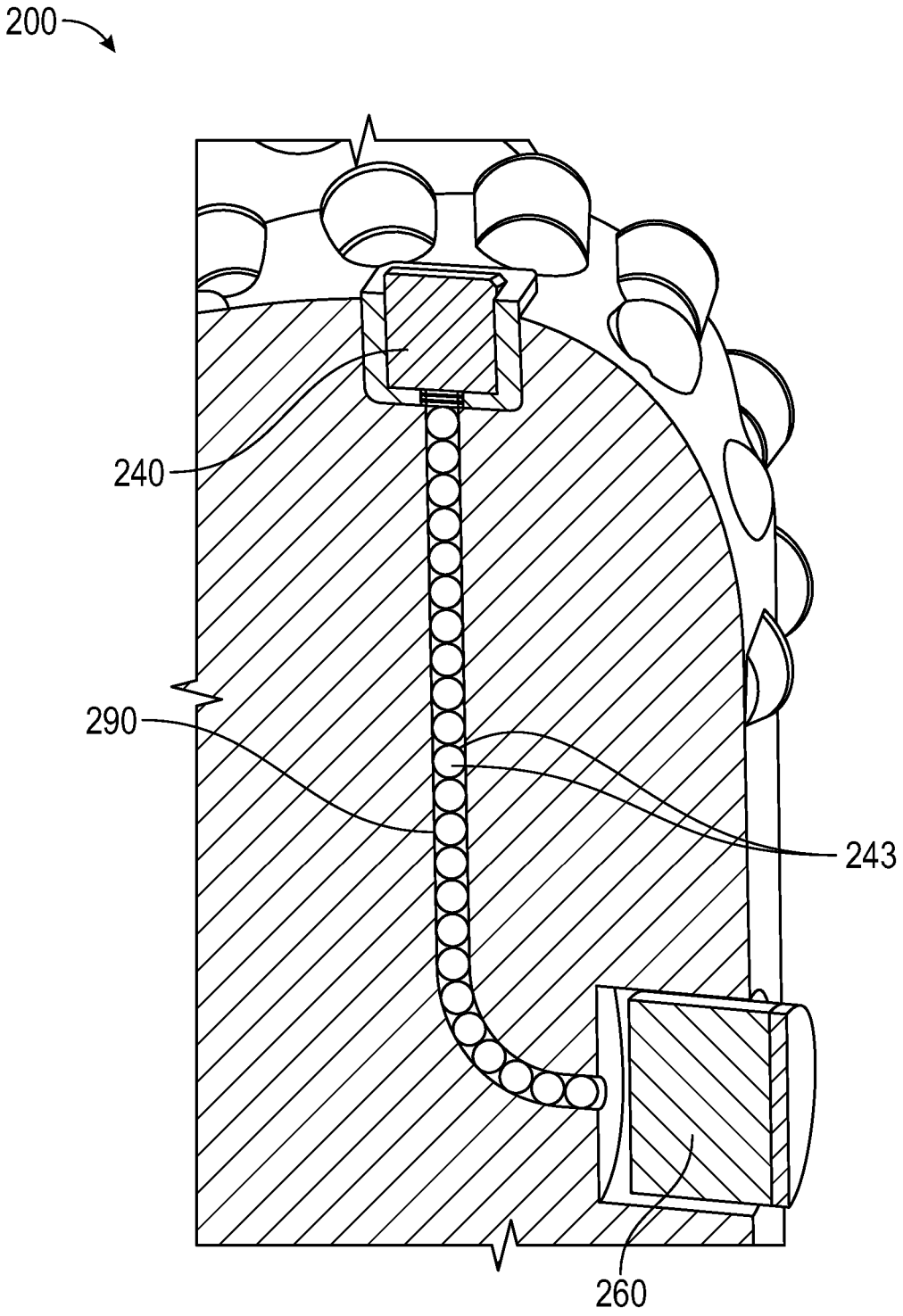
FIG. 6 is the cross section of an illustrative blade of a drill bit with optional ball bearings in the communication channel.

In one or more embodiments, a communication channel 290 may be formed between the first pocket 241 and the second pocket 261 within the drill bit 200. The communication channel may be filled with a fluid, such as a hydraulic fluid. Further, in one or more embodiments, the DOCC element 240 may form a seal within the first pocket 241 and the gauge element 260 may form a seal within the second pocket 261 such that the DOCC element 240, the gauge element 260, and the fluid disposed within the communication channel 290 form a piston. Thus, in one or more embodiments, external forces on the gauge element 260 which cause the gauge element 260 to retract into the second pocket 261 of the drill bit 200 will cause the DOCC element 240 to extend further outward from the first pocket 241 of the drill bit 200 due to the piston formed therebetween. In one or more embodiments, external forces on the gauge element 260 may include forces on the gauge element 260 from the side wall of the wellbore. Similarly, external forces on the DOCC element 240 which cause the DOCC element 240 to retract into the first pocket 241 of the drill bit 200 will cause the gauge element 260 to extend further outward from the second pocket 261 of the drill bit 200 due to the piston formed therebetween. In one or more embodiments, external forces on the DOCC element 240 may include the weight on bit. By way of example only, when the drill bit 200 changes from drilling a non-linear portion of a wellbore to drilling a linear portion of the wellbore, the width of the wellbore may become larger, allowing the gauge element 260 to extend further out of the gauge zone 280*d* of the blade 211 to engage the adjacent portion of the wellbore, and the extension of the gauge element 260 may cause the DOCC element 240 to retract into the drill bit 200 as a result of a force of the piston. Further, while in one or more embodiments, a fluid is disposed within the communication channel 290 to create a piston, in other embodiments, e.g., see FIG. 6, ball bearings 243 may be disposed within the communication channel such that the DOCC element 240 and the gauge element 260 may each contact one of the ball bearings 243 and may be configured to shift the ball bearings 243 within the communication channel 290 when the respective element is retracted such that the other element is extended due to the shifting of the ball bearings 243.

Furthermore, in one or more embodiments, a reservoir (not shown) may be formed at a bottom of the first pocket 241, the second pocket 261, or both. The reservoir may be configured to create a ratio between the movement of the DOCC element 240 and the movement of the gauge element 260 such that external forces on one element shift the other element more or less than the one element. By way of example only, a reservoir may be formed at a bottom of the second pocket 261 such that when external forces of the wellbore on the gauge element 260 retract the gauge element 260 into the drill bit 200 by a first distance, the DOCC element 240 is extended from the drill bit 200 by a second distance which is greater than the first distance. Furthermore, in one or more embodiments, the reservoir may additionally be configured to dampen the rate at which the retraction of one element causes the other element to extend in order to maintain smooth cutting of the formation when drilling the wellbore. Additionally, in one or more embodiments, shock absorbers may be disposed between the gauge element and the piston and/or between the DOCC element and the piston so as to dampen the rate at which the retraction of one element causes the other element to extend. In one or more embodiments, the shock absorbers may include a hard elastomer. Further, in one or more embodiments, a check valve 242 may be disposed within the communication channel so as to dampen the rate at which the retraction of one element causes the other element to extend.

Figure 3:
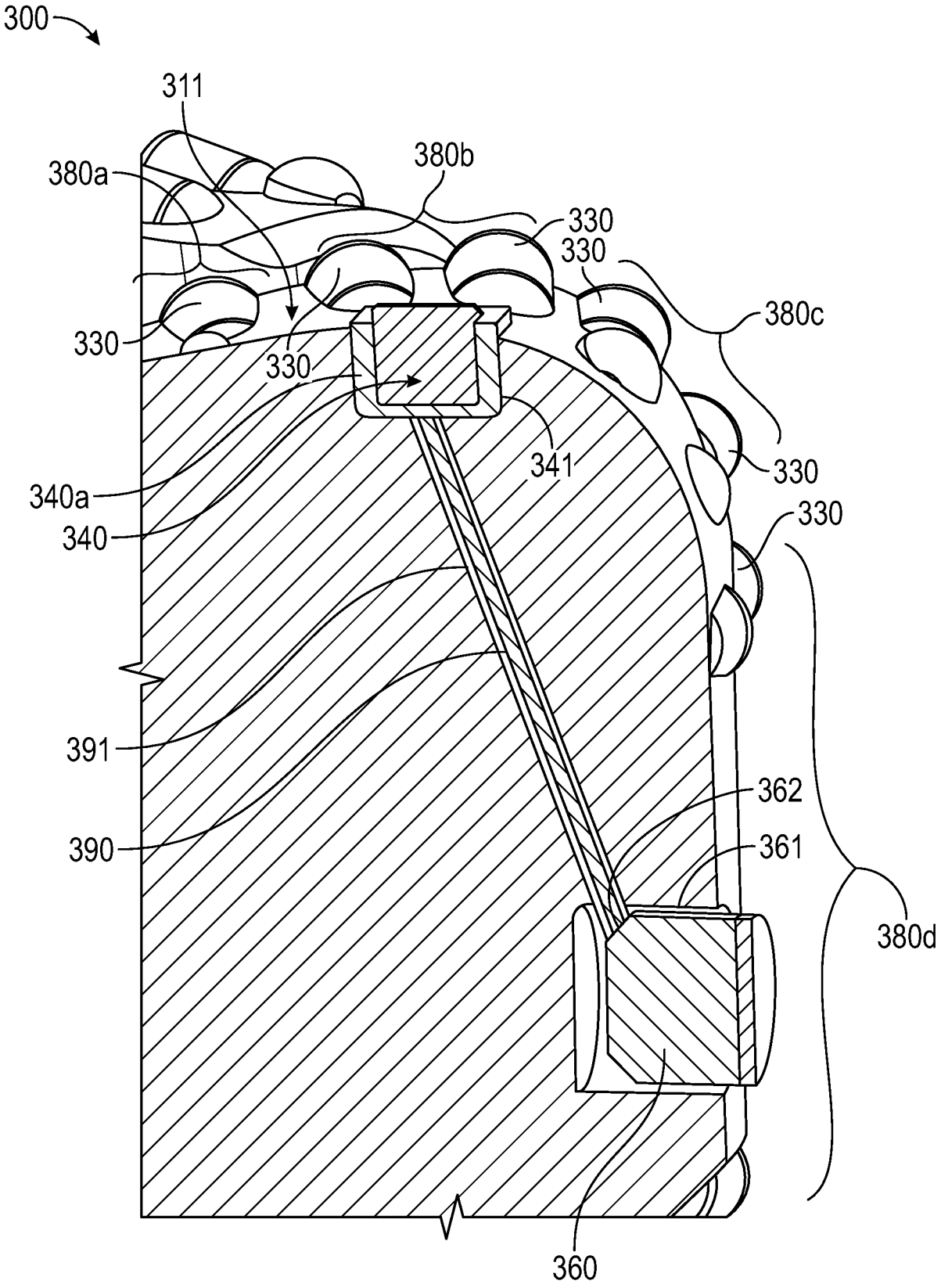
FIG. 3 is a cross section of another illustrative blade of a drill bit according to one or more aspects of the present disclosure.

Referring now to FIG. 3, a cross section of a blade 311 of a drill bit 300 is illustrated according to one or more aspects of the present disclosure. In one or more embodiments, the blade 311 may include a plurality of cutting elements 330, a DOCC element 340, and a gauge element 360. The plurality of cutting elements 330 and the DOCC element 340 may be configured to protrude from an external surface of the blade 311. Further, the DOCC element 340 may be disposed in and coupled to a first pocket 341 formed in an external surface of the blade 311. The DOCC element 340 may be configured to control the depth of cut of the plurality of cutting elements 330 as necessitated by the conditions of the wellbore being drilled. In one or more embodiments, the DOCC element 340 may include a roller element, an impact arrestor, a backup cutter, and/or an MDR. Further, in one or more embodiments, the DOCC element 340 may be configured to extend or retract between a first position in which the DOCC element 340 protrudes from the surface of the blade 311 by a first distance and a second position in which the DOCC element 340 protrudes from the surface of the blade 311 by a second distance, which is less than the first distance. Further, in one or more embodiments, one or more springs (not shown) may be disposed behind the DOCC element 340 within the first pocket 341 so as to bias the DOCC element 340 outward from the surface of the blade 311. While a single DOCC element 340 is depicted, in one or more embodiments, the blade 311 may include a plurality of DOCC elements. Additionally, while the DOCC element 340 is depicted as being disposed in a nose zone **380*b* of the blade 311, in one or more embodiments, the DOCC element 340 may be disposed in the cone zone 380*a* or the shoulder zone 380*c* of the blade 311**.

Further, the gauge element 360 may be configured to protrude from the external surface of the blade 311. In one or more embodiments, the gauge element 360 may be disposed in and coupled to a second pocket 361 formed in a gauge zone **380*d* of the blade 311. Further, in one or more embodiments, the gauge element 360 may be configured to extend or retract between a first position in which the gauge element 360 protrudes from the surface of the blade 311 by a first distance and a second position in which the gauge element 360 protrudes from the surface of the blade 311 by a second distance, which is less than the first distance. The gauge element 360 may engage adjacent portions of the wellbore and may be configured to enhance the stability of the drill bit 300 during both linear (i.e., vertical or lateral drilling) and non-linear (i.e., curved drilling between vertical and lateral) drilling. In one or more embodiments, the gauge element 360 may have some, little, or no cutting capability. Additionally, in one or more embodiments, the gauge element 360 may be configured to extend from and retract into the gauge zone 380*d* of the blade 311 based on engagement with adjacent portions of the wellbore. Further, in one or more embodiments, the gauge element 360 may be biased radially outward from a central axis of the drill bit 300. One or more springs (not shown) may be disposed between the gauge element 360 and a bottom of the second pocket 361 in one or more embodiments so as to bias the gauge element 360 outward from the central axis of the drill bit 300. Thus, in one or more embodiments, springs may be disposed behind the DOCC element 340, the gauge element 360, or both. Furthermore, in one or more embodiments, the gauge element 360 of the blade 311 may be coupled to the DOCC element 340 such that when the gauge element 360 is retracted into the drill bit 300, the DOCC element 340 is extended from the surface of the blade 311, and such that when the gauge element 360 is extended from the drill bit 300, the DOCC element 340 is retracted into the drill bit 300**.

In one or more embodiments, a communication channel 390 may be formed between the first pocket 341 and the second pocket 361 within the drill bit 300. A rod 391 may disposed through the communication channel 390, and the rod 391 may be configured to contact both the DOCC element 340 and the gauge element 360. In one or more embodiments, the rod 390 may be longer than the communication channel 390 and may extend into both the first pocket 341 and the second pocket 361 such that it engages both the DOCC element 340 and the gauge element 360 simultaneously. Thus, in one or more embodiments, external forces on the gauge element 360 which cause the gauge element 360 to retract into the second pocket 361 of the drill bit 300 will cause the DOCC element 340 to extend further outward from the first pocket 341 of the drill bit 300 due to the retraction of the gauge element 360 into the second pocket 361 causing the rod 391 to extend further into the first pocket 341 while contacting the DOCC element 340. In one or more embodiments, external forces on the gauge element 360 may include forces on the gauge element 260 from the side wall of the wellbore. Similarly, external forces on the DOCC element 340 which cause the DOCC element 340 to retract into the first pocket 341 of the drill bit 300 will cause the gauge element 360 to extend further outward from the second pocket 361 of the drill bit 300 due to the retraction of the DOCC element 340 into the first pocket 341 causing the rod 391 to extend further into the second pocket 361 while contacting the gauge element 360. In one or more embodiments, external forces on the DOCC element 340 may include the weight on bit. By way of example only, when the drill bit 300 changes from drilling a non-linear portion of a wellbore to drilling a linear portion of the wellbore, the width of the wellbore may become larger, allowing the gauge element 360 to extend further out of the gauge zone 380*d* of the blade 311 to engage the adjacent portion of the wellbore, and the extension of the gauge element 360 may cause the DOCC element 340 to retract into the drill bit 300 as a result of a force of the rod 391. Additionally, in one or more embodiments, shock absorbers may be disposed between the gauge element and the piston and/or between the second gauge element and the piston so as to dampen the rate at which the retraction of one element causes the other element to extend. In one or more embodiments, the shock absorbers may include a hard elastomer.

In one or more embodiments, the DOCC element 340, the gauge element 360, or both may have a tapered surface (e.g., tapered surface 362) upon which the rod 391 bears such that extension of the rod 391 into the first pocket 341 or the second pocket 361 may slide along the tapered surface and may cause the DOCC element 340 or the gauge element 360 to extend further from the drill bit 300, respectively. Further, in one or more embodiments, the DOCC element 340, the gauge element 360, or both may be disposed within an element housing (e.g., 340*a*), and the element housing may include a catch (not shown) in which one end of the rod 391 may be disposed such that the rod 391 does not fall out of engagement with either the DOCC element 340 or the gauge element 360 if either the DOCC element 340 or the gauge element 360 over-extend outward from the drill bit 300. In one or more embodiments, the catch may be a retaining ring formed in the element housing within which the rod 391 is disposed. Further, in one or more embodiments, the catch may be a cross pin disposed in the element housing and coupled to the rod 391.

Figure 4:
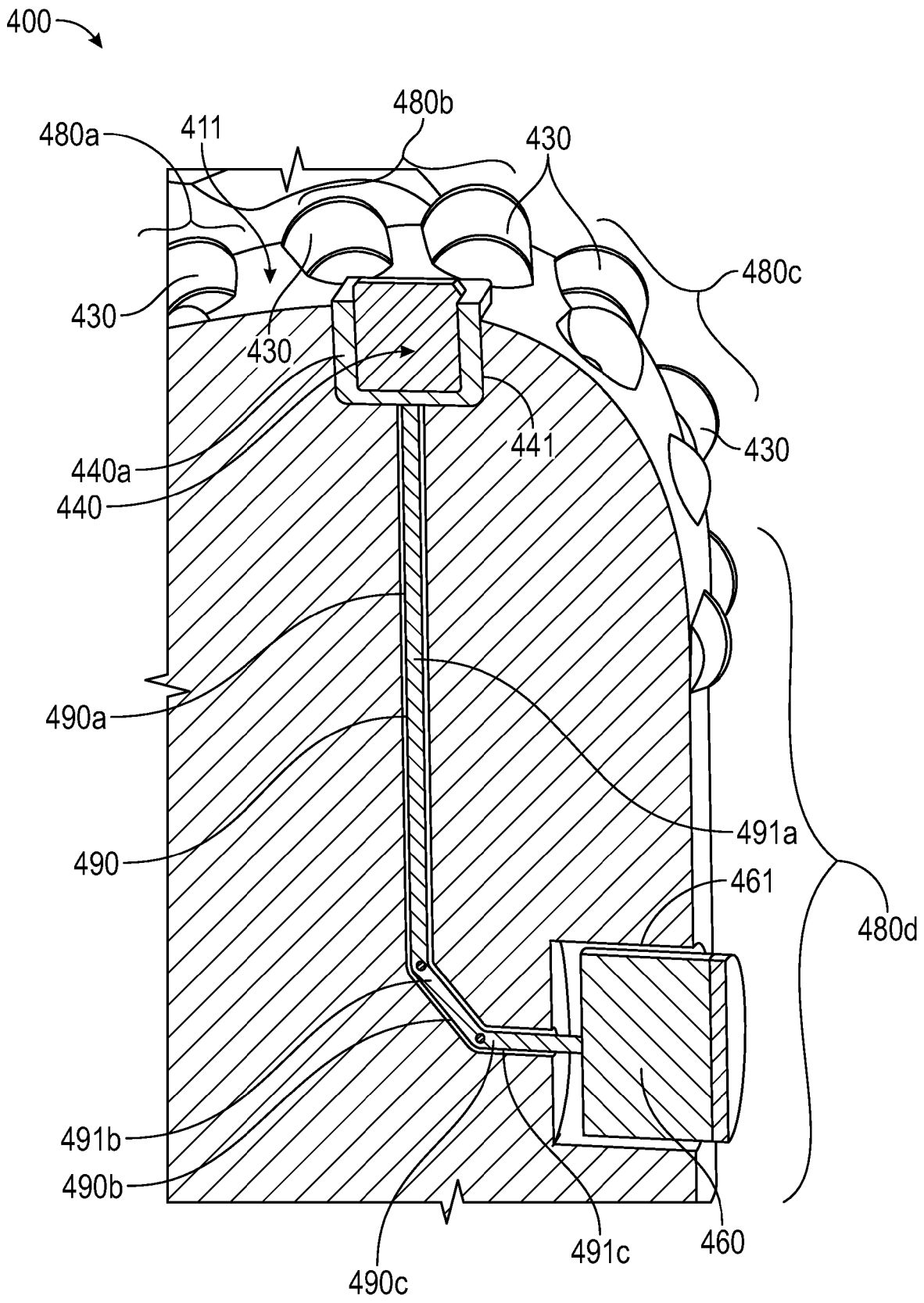
FIG. 4 is a cross section of another illustrative blade of a drill bit according to one or more aspects of the present disclosure.

Referring now to FIG. 4, a cross section of a blade 411 of a drill bit 400 is illustrated according to one or more aspects of the present disclosure. In one or more embodiments, the blade 411 may include a plurality of cutting elements 430, a DOCC element 440, and a gauge element 460. The plurality of cutting elements 430 and the DOCC element 440 may be configured to protrude from an external surface of the blade 411. Further, the DOCC element 440 may be disposed in and coupled to a first pocket 441 formed in an external surface of the blade 411. The DOCC element 440 may be configured to control the depth of cut of the plurality of cutting elements 430 as necessitated by the conditions of the wellbore being drilled. In one or more embodiments, the DOCC element 440 may include a roller element, an impact arrestor, a backup cutter, and/or an MDR. Further, in one or more embodiments, the DOCC element 440 may be configured to extend or retract between a first position in which the DOCC element 440 protrudes from the surface of the blade 411 by a first distance and a second position in which the DOCC element 440 protrudes from the surface of the blade 411 by a second distance, which is less than the first distance. Further, in one or more embodiments, one or more springs (not shown) may be disposed behind the DOCC element 440 within the first pocket 441 so as to bias the DOCC element 440 outward from the surface of the blade 411. While a single DOCC element 440 is depicted, in one or more embodiments, the blade 411 may include a plurality of DOCC elements. Additionally, while the DOCC element 440 is depicted as being disposed in a nose zone 480*b* of the blade 411, in one or more embodiments, the DOCC element 440 may be disposed in the cone zone 480*a* or the shoulder zone 480*c* of the blade 411.

Further, the gauge element 460 may be configured to protrude from the external surface of the blade 411. In one or more embodiments, the gauge element 460 may be disposed in and coupled to a second pocket 461 formed in a gauge zone 480*d* of the blade 411. Further, in one or more embodiments, the gauge element 460 may be configured to extend or retract between a first position in which the gauge element 460 protrudes from the surface of the blade 411 by a first distance and a second position in which the gauge element 460 protrudes from the surface of the blade 411 by a second distance, which is less than the first distance. The gauge element 460 may engage adjacent portions of the wellbore and may be configured to enhance the stability of the drill bit 400 during both linear (i.e., vertical or lateral drilling) and non-linear (i.e., curved drilling between vertical and lateral) drilling. In one or more embodiments, the gauge element 460 may have some, little, or no cutting capability. Additionally, in one or more embodiments, the gauge element 460 may be configured to extend from and retract into the gauge zone 480*d* of the blade 411 based on engagement with adjacent portions of the wellbore. Further, in one or more embodiments, the gauge element 460 may be biased radially outward from a central axis of the drill bit 400. One or more springs (not shown) may be disposed between the gauge element 460 and a bottom of the second pocket 461 in one or more embodiments so as to bias the gauge element 460 outward from the central axis of the drill bit 400. Thus, in one or more embodiments, springs may be disposed behind the DOCC element 440, the gauge elements 460, or both. Furthermore, in one or more embodiments, the gauge element 460 of the blade 411 may be coupled to the DOCC element 440 such that when the gauge element 460 is retracted into the drill bit 400, the DOCC element 440 is extended from the surface of the blade 411, and such that when the gauge element 460 is extended from the drill bit 400, the DOCC element 440 is retracted into the drill bit 400.

In one or more embodiments, a communication channel 490 may be formed between the first pocket 441 and the second pocket 461 within the drill bit 400. The communication channel 490 may include a plurality of portions 490*a-c*, and one rod of a plurality of rods 491*a-c* may disposed within each of the portions 490*a-c* of the communication channel 490. A first rod 491*a* may be disposed within a first portion 490*a* of the communication channel 490 and may be coupled to the DOCC element 440 on a first end and to a second rod 491*b* on a second end. The second rod 491*b* may be disposed within a second portion 490*b* of the communication channel 490 and may be coupled to the first rod 491*a* on a first end and to a third rod 491*c* on a second end. The third rod 491 may be disposed within a third portion 490*c* of the communication channel 490 and may be coupled to the second rod 491*b* on a first end and to the gauge element 460 on a second end. Further, in one or more embodiments, the rods 490*a-c* may be coupled together by way of hinges. Furthermore, while three rods 491*a-c* are depicted, in one or more embodiments, two or more rods may be used and may be coupled at their ends to and between the DOCC element 440 and the gauge element 460. Additionally, while a plurality of rods are depicted, in one or more embodiments, ball bearings may be disposed within the communication channel 490 and configured to shift one of the elements as a result of external forces causing the other element to retract into the drill bit. Further, in one or more embodiments, a combination of rods and ball bearings may be disposed within the communication channel 490 and may be configured to shift one of the elements as a result of external forces causing the other element to retract into the drill bit.

Further, in one or more embodiments, the plurality of portions 490*a-c* may be wider than the width of the plurality of rods 491*a-c* such that when the first rod 491*a* is pushed further into the communication channel 490 from the first pocket 441, the third rod 491*c* is pushed further outward from the communication channel 490 into the second pocket 461, and when the third rod 491*c* is pushed further into the communication channel 490 from the second pocket 461, the first rod 491*a* is pushed further outward from the communication channel 490 into the first pocket 441. Thus, in one or more embodiments, external forces on the gauge element 460 which cause the gauge element 460 to retract into the second pocket 461 of the drill bit 400 will cause the DOCC element 440 to extend further outward from the first pocket 441 of the drill bit 400 due to the retraction of the gauge element 460 into the second pocket 461 causing the third rod 491*c* to retract into the communication channel 490 and the first rod 491*a* to extend further into the first pocket 441 while contacting the DOCC element 440. In one or more embodiments, external forces on the gauge element 260 may include forces on the gauge element 460 from the side wall of the wellbore. Similarly, external forces on the DOCC element 440 which cause the DOCC element 440 to retract into the first pocket 441 of the drill bit 400 will cause the gauge element 460 to extend further outward from the second pocket 461 of the drill bit 400 due to the retraction of the DOCC element 440 into the first pocket 441 causing the first rod 491*a* to retract into the communication channel 490 and the third rod 491*c* to extend further into the second pocket 461 while contacting the gauge element 460. In one or more embodiments, external forces on the DOCC element 440 may include the weight on bit. By way of example only, when the drill bit 400 changes from drilling a non-linear portion of a wellbore to drilling a linear portion of the wellbore, the width of the wellbore may become larger, allowing the gauge element 460 to extend further out of the gauge zone 480*d* of the blade 411 to engage the adjacent portion of the wellbore, and the extension of the gauge element 460 may cause the DOCC element 440 to retract into the drill bit 400 as a result of a force of the plurality of rods 491*a-c*. Additionally, in one or more embodiments, shock absorbers may be disposed between the first gauge element and the piston and/or between the second gauge element and the piston so as to dampen the rate at which the retraction of one element causes the other element to extend. In one or more embodiments, the shock absorbers may include a hard elastomer.

In one or more embodiments, the DOCC element 440, the gauge element 460, or both may be disposed within an element housing (e.g., 440*a*), and the element housing may include a catch (not shown) in which one end of the first rod 491*a* or the third rod 491*c* may be disposed such that the rods do not fall out of engagement with either the DOCC element 440 or the gauge element 460 if either the DOCC element 440 or the gauge element 460 over-extend outward from the drill bit 400. In one or more embodiments, the catch may be a retaining ring formed in the element housing within which the first rod 491*a* or the third rod 491*c* is disposed. Further, in one or more embodiments, the catch may be a cross pin disposed in the element housing and coupled to the first rod 491*a* or the third rod 491*c*.

Figure 5:
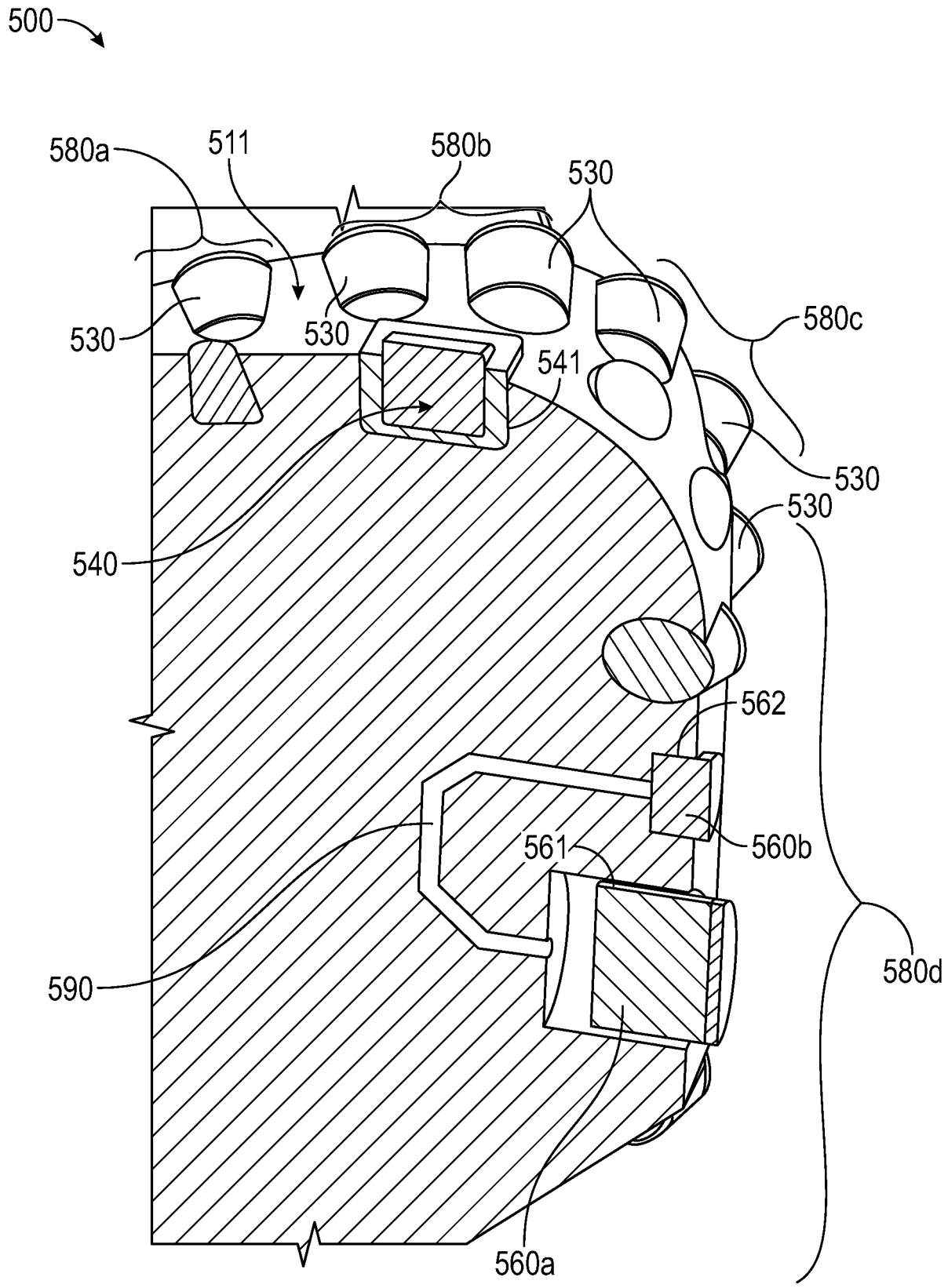
FIG. 5 is a cross section of another illustrative blade of a drill bit according to one or more aspects of the present disclosure.

Referring now to FIG. 5, a cross section of a blade 511 of a drill bit 500 is illustrated according to one or more aspects of the present disclosure. In one or more embodiments, the blade 511 may include a plurality of cutting elements 530, a DOCC element 540, a first gauge element 560*a*, and a second gauge element 560*b*. The plurality of cutting elements 530 and the DOCC element 540 may be configured to protrude from an external surface of the blade 511. Further, the DOCC element 540 may be disposed in and coupled to a first pocket 541 formed in an external surface of the blade 511. The DOCC element 540 may be configured to control the depth of cut of the plurality of cutting elements 530. In one or more embodiments, the DOCC element 540 may be a roller element, an impact arrestor, a backup cutter, or an MDR. While a single DOCC element 540 is depicted, in one or more embodiments, the blade 511 may include a plurality of DOCC elements. Additionally, while the DOCC element 540 is depicted as being disposed in a nose zone 580*b* of the blade 511, in one or more embodiments, the DOCC element 540 may be disposed in the cone zone 580*a* or the shoulder zone 580*c* of the blade 511.

Further, the first gauge element 560*a* and the second gauge element 560*b* may be configured to protrude from the external surface of the blade 511. In one or more embodiments, the first gauge element 560*a* may be disposed in and coupled to a second pocket 561 formed in a gauge zone 580*d* of the blade 511, and the second gauge element 560*b* may be disposed in and coupled to a third pocket 562 formed in a gauge zone 580*d* of the blade 511. Further, in one or more embodiments, the first gauge element 560*a* may be configured to extend or retract between a first position in which the first gauge element 560*a* protrudes from the surface of the blade 511 by a first distance and a second position in which the first gauge element 560*a* protrudes from the surface of the blade 511 by a second distance, which is less than the first distance. Furthermore, in one or more embodiments, the second gauge element 560*b* may be configured to extend or retract between a first position in which the second gauge element 560*b* protrudes from the surface of the blade 511 by a first distance and a second position in which the second gauge element 560*b* protrudes from the surface of the blade 511 by a second distance, which is less than the first distance. The first gauge element 560*a* and the second gauge element 560*b* may engage adjacent portions of the wellbore and may be configured to enhance the stability of the drill bit 500 during both linear (i.e., vertical or lateral drilling) and non-linear (i.e., curved drilling between vertical and lateral) drilling. In one or more embodiments, the first gauge element 560*a* and the second gauge element 560*b* may have some, little, or no cutting capability. Additionally, in one or more embodiments, the first gauge element 560*a* and the second gauge element 560*b* may be configured to extend from and retract into the gauge zone 580*d* of the blade 511 based on engagement with adjacent portions of the wellbore. Further, in one or more embodiments, one of the first gauge element 560*a* or the second gauge element 560*b* may be biased radially outward from a central axis of the drill bit 500. One or more springs (not shown) may be disposed between the first gauge element 560*a* and a bottom of the second pocket 561 and/or between the second gauge element 560*b* and a bottom of the third pocket 562 in one or more embodiments so as to bias one or both of the first gauge element 560*a* or the second gauge element 560*b* outward from the central axis of the drill bit 500. Furthermore, in one or more embodiments, the first gauge element 560*a* may be coupled to the second gauge element 560*b* such that when the first gauge element 560*a* is retracted into the drill bit 500, the second gauge element 560*b* is extended from the surface of the blade 511, and such that when the first gauge element 560*a* is extended from the drill bit 500, the second gauge element 560*b* is retracted into the drill bit 500.

In one or more embodiments, a communication channel 590 may be formed between the second pocket 561 and the third pocket 562 within the drill bit 500. The communication channel may be filled with a fluid, such as a hydraulic fluid.

Further, in one or more embodiments, the first gauge element 560*a* may form a seal within the second pocket 561 and the second gauge element 560*b* may form a seal within the third pocket 562 such that the first gauge element 560*a*, the second gauge element 560*b*, and the fluid disposed within the communication channel 590 form a piston. Thus, in one or more embodiments, external forces on the first gauge element 560*a* which cause the first gauge element 560*a* to retract into the second pocket 561 of the drill bit 500 will cause the second gauge element 560*b* to extend further outward from the third pocket 562 of the drill bit 500 due to the piston formed therebetween. Similarly, external forces on the second gauge element 560*b* which cause the second gauge element 560*b* to retract into the third pocket 562 of the drill bit 500 will cause the first gauge element 560*a* to extend further outward from the second pocket 561 of the drill bit 500 due to the piston formed therebetween. In one or more embodiments, external forces on the first gauge element 560*a* and/or the second gauge element 560*b* may include forces from the side wall of the wellbore. By way of example only, when the drill bit 500 changes from drilling a non-linear portion of a wellbore to drilling a linear portion of the wellbore, the width of the wellbore may become larger, which may allow either the first gauge element 560*a* or the second gauge element 560*b* to extend further out of the gauge zone 580*d* of the blade 511 to engage the adjacent portion of the wellbore depending on the tilt of the drill bit, which will cause the other gauge element to retract into the drill bit 500 as a result of a force of the piston. Further, while in one or more embodiments, a fluid is disposed within the communication channel 590 to create a piston, in other embodiments, ball bearings may be disposed within the communication channel such that the first gauge element and the second gauge element may each contact one of the ball bearings and may be configured to shift the ball bearings within the communication channel when the element is retracted such that the other element is extended due to the shifting of the ball bearings.

Furthermore, in one or more embodiments, a reservoir (not shown) may be formed at a bottom of the second pocket 561, the third pocket 562, or both. The reservoir may be configured to create a ratio between the movement of the first gauge element 560*a* and the movement of the second gauge element 560*b* such that external forces on one element shift the other element more or less than the one element. By way of example only, a reservoir may be formed at a bottom of the second pocket 561 such that when external forces of the wellbore on the first gauge element 560*a* retract the first gauge element 560*a* into the drill bit 500 by a first distance, the second gauge element 560*b* is extended from the drill bit 500 by a second distance which is greater than the first distance. Furthermore, in one or more embodiments, the reservoir may additionally be configured to dampen the rate at which the retraction of one element causes the other element to extend in order to maintain smooth cutting of the formation when drilling the wellbore. Additionally, in one or more embodiments, shock absorbers may be disposed between the first gauge element and the piston and/or between the second gauge element and the piston so as to dampen the rate at which the retraction of one element causes the other element to extend. In one or more embodiments, the shock absorbers may include a hard elastomer. Further, in one or more embodiments, a check valve may be disposed within the communication channel so as to dampen the rate at which the retraction of one element causes the other element to extend.

According to one or more aspects of the present disclosure, the drill bit described herein is an efficient and cost-effective drill bit that passively adjusts the depth of cut of the drill bit and stabilizes the drill bit in order to extend the life of the drill bit and reduce drilling dysfunctions that may occur when drilling a wellbore. The drill bit according to one or more aspects of the present disclosure limits fluctuations in torque, improves stability of the drill bit at high rates of penetration, and minimizes stick slip, which can cause damage to the cutting elements, thus improving the performance of the drill bit. Further, while one or more embodiments of the present disclosure depict a drill bit, in one or more embodiments, the DOCC elements and gauge elements may be incorporated into an underreamer as described above, and the underreamer will experience the same benefits as the depicted drill bits.

An embodiment of the present disclosure is a drill bit including: a bit body; and a blade extending from the bit body. The blade includes: a first element protruding from a surface of the blade; and a second element protruding from the surface of the blade. The first element is configured to extend or retract relative to the surface of the blade, and the second element is configured to extend or retract relative to the surface of the blade. Further, the first element is coupled to the second element such that when the second element retracts relative to the surface of the blade, the first element extends relative to the surface of the blade.

In one or more embodiments described in the preceding paragraph, the blade further includes: a first pocket formed in the surface of the blade, where the first element is disposed within the first pocket; and a second pocket formed in the surface of the blade, where the second element is disposed within the second pocket. In one or more embodiments described in the preceding paragraph, the blade further includes a communication channel formed between the first pocket and the second pocket. In one or more embodiments described in the preceding paragraph, a fluid is disposed within the communication channel, the first element forms a first seal within the first pocket, and the second element forms a second seal within the second pocket. In one or more embodiments described in the preceding paragraph, a reservoir is formed at a bottom of the first pocket, at a bottom of the second pocket, or at a bottom of the first pocket and at a bottom of the second pocket. In one or more embodiments described in the preceding paragraph, a check valve is disposed within the communication channel. In one or more embodiments described in the preceding paragraph, a plurality of ball bearings is disposed within the communication channel, a first ball bearing of the plurality of ball bearings is configured to contact the first element within the first pocket, and a second ball bearing of the plurality of ball bearings is configured to contact the second element within the second pocket. In one or more embodiments described in the preceding paragraph, a rod is disposed through the communication channel, and the rod is configured to contact the first element and the second element. In one or more embodiments described in the preceding paragraph, one of the first element or the second element includes a tapered surface, and the rod is configured to bear against the tapered surface. In one or more embodiments described in the preceding paragraph, the drill bit further includes an element housing within which one of the first element or the second element are disposed, the element housing includes a catch, and a first end of the rod is disposed within the catch. In one or more embodiments described in the preceding paragraph, the catch is a retaining ring, and the rod is coupled to the retaining ring. In one or more embodiments described in the preceding paragraph, the catch is a cross pin, and a first end of the rod is coupled to the cross pin. In one or more embodiments described in the preceding paragraph, the communication channel includes a plurality of portions, a plurality of rods is disposed through the plurality of portions, and the plurality of rods is coupled between the first element and the second element. In one or more embodiments described in the preceding paragraph, the surface of the blade includes a cone zone, a nose zone, a shoulder zone, and a gauge zone, the first pocket is formed in one of the cone zone, the nose zone, or the shoulder zone, and the second pocket is formed in the gauge zone. In one or more embodiments described in the preceding paragraph, the surface of the blade includes a cone zone, a nose zone, a shoulder zone, and a gauge zone, the first pocket is formed in the gauge zone, and the second pocket is formed in the gauge zone. In one or more embodiments described in the preceding paragraph, the drill bit further includes a spring, where the spring is disposed between one of the first element and a bottom of the first pocket or the second element and a bottom of the second pocket. In one or more embodiments described in the preceding paragraph, the drill bit further includes one or more shock absorbers disposed between one of the first element and a bottom of the first pocket or the second element and a bottom of the second pocket. In one or more embodiments described in the preceding paragraph, the blade further includes a plurality of cutting elements. In one or more embodiments described in the preceding paragraph, the first element is a depth of cut control element. In one or more embodiments described in the preceding paragraph, when the drill bit is disposed within a wellbore, the second element extends relative to the surface of the blade when a width of the wellbore increases and the second element retracts relative to the surface of the blade when a width of the wellbore decreases.

The present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The disclosure illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces

What is claimed is:

1. A drill bit, comprising:

a bit body; and a blade extending from the bit body, wherein the blade comprises:

a plurality of cutting elements protruding from a surface of the blade, the surface of the blade including a cone zone, a nose zone, a shoulder zone, and a gauge zone;

a first pocket formed in the surface of the blade in one of the cone zone, the nose zone, or the shoulder zone, wherein a first element is disposed within the first pocket protruding from the surface of the blade, wherein the first element is a depth of cut control (DOCC) element or a non-cutting gauge element and is configured to extend or retract relative to the surface of the blade; and a second pocket formed in the surface of the blade in the gauge zone, wherein a second element is disposed within the second pocket protruding from the surface of the blade, wherein the second element is a DOCC element or a non-cutting gauge element and is configured to extend or retract relative to the surface of the blade, and wherein the first element is coupled to the second element such that when the second element retracts relative to the surface of the blade, the first element extends relative to the surface of the blade.

2. The drill bit of claim 1, wherein the blade further comprises a communication channel formed between the first pocket and the second pocket.

3. The drill bit of claim 2, wherein:

a fluid is disposed within the communication channel;

the first element forms a first seal within the first pocket; and the second element forms a second seal within the second pocket.

4. The drill bit of claim 3, wherein a reservoir is formed at a bottom of the first pocket, at a bottom of the second pocket, or at the bottom of the first pocket and at the bottom of the second pocket.

5. The drill bit of claim 1, wherein the first element is a DOCC element and the second element is a non-cutting gauge element.

6. The drill bit of claim 1, wherein the first element and the second element are both non-cutting gauge elements.

7. The drill bit of claim 1, wherein:

the communication channel includes a plurality of portions;

a plurality of rods is disposed through the plurality of portions; and the plurality of rods is coupled between the first element and the second element.

8. The drill bit of claim 1, further comprising:

a spring, wherein the spring is disposed between one of the first element and a bottom of the first pocket or the second element and a bottom of the second pocket.

9. The drill bit of claim 1, further comprising:

one or more shock absorbers disposed between one of the first element and a bottom of the first pocket or the second element and a bottom of the second pocket.

10. The drill bit of claim 1, wherein the blade is one of a plurality of blades of the drill bit, wherein the plurality of cutting elements are secured among the plurality of blades.

11. The drill bit of claim 1, wherein each of the first and second elements is a DOCC element.

12. The drill bit of claim 1, wherein the second element is biased to alternately extend or retract based on a width of a wellbore during drilling.

13. A drill bit, comprising:

a bit body; and a blade extending from the bit body, wherein the blade comprises:

a plurality of cutting elements protruding from a surface of the blade;

a first pocket formed in the surface of the blade, wherein a first element is disposed within the first pocket protruding from the surface of the blade, wherein the first element is a depth of cut control (DOCC) element or a non-cutting gauge element and is configured to extend or retract relative to the surface of the blade;

a second pocket formed in the surface of the blade, wherein a second element is disposed within the second pocket protruding from the surface of the blade, wherein the second element is a DOCC element or a non-cutting gauge element and is configured to extend or retract relative to the surface of the blade, and wherein the first element is coupled to the second element such that when the second element retracts relative to the surface of the blade, the first element extends relative to the surface of the blade;

a communication channel formed between the first pocket and the second pocket;

a rod disposed through the communication channel, wherein the rod contacts the first element and the second element;

wherein one of the first element or the second element includes a tapered surface; and the rod bears against the tapered surface.

14. The drill bit of claim 13, further comprising:

an element housing within which the first or second element is disposed within the respective first or second pocket.

15. The drill bit of claim 14, wherein the first element and the second element are each disposed in a respective element housing in the respective first and second pockets.

16. The drill bit of claim 14, wherein the rod extends through the element housing to the first or second element disposed in the element housing.

17. The drill bit of claim 13, wherein:

the surface of the blade includes a cone zone, a nose zone, a shoulder zone, and a gauge zone;

the first pocket is formed in the gauge zone; and the second pocket is formed in the gauge zone.

18. The drill bit of claim 13, wherein the first element is a DOCC element and the second element is a non-cutting gauge element.

19. The drill bit of claim 13, wherein the first element and the second element are both non-cutting gauge elements.

20. The drill bit of claim 13, further comprising:

a spring, wherein the spring is disposed between one of the first element and a bottom of the first pocket or the second element and a bottom of the second pocket.

* * * * *